US005943894A

United States Patent [19]

Krämer

[11] Patent Number: 5,943,894

[45] Date of Patent: Aug. 31, 1999

[54] METHOD OF ROLLING PLATES

[75] Inventor: Stephan Krämer, Hilchenbach, Germany

[73] Assignee: SMS Schloemann-Siemag Aktiengesellschaft, Düsseldorf, Germany

[21] Appl. No.: 08/963,703

[22] Filed: Nov. 4, 1997

[30] Foreign Application Priority Data

Nov. 5, 1996 [DE] Germany ..... 196 45 497

[51] Int. Cl.[6] ..... B21B 41/06

[52] U.S. Cl. ..... 72/229; 72/365.2

[58] Field of Search ..... 72/10.7, 226, 229, 72/234, 365.2

[56] References Cited

U.S. PATENT DOCUMENTS 4,555,922 12/1985 Ginzburg .

FOREIGN PATENT DOCUMENTS

| | | | |
|---|---|---|---|
| 1059144 | 5/1954 | France . | |
| 60-61106 | 4/1985 | Japan | 72/229 |
| 60-102208 | 6/1985 | Japan | 72/229 |
| 63-144815 | 6/1988 | Japan | 72/229 |
| 3-99711 | 4/1991 | Japan | 72/229 |
| 942840 | 7/1982 | U.S.S.R. | 72/10.4 |
| 11111576 | 5/1968 | United Kingdom . | |
| 2308083 | 6/1997 | United Kingdom . | |
| 8911363 | 11/1930 | WIPO . | |

OTHER PUBLICATIONS

Database WPI, Section CH, Week 9025, Derwent Publications Ltd., London GB; & SU 1503902 A (Moscow Steel Alloys Inst), Aug. 30, 1989.

Patent Abstracts of Japan, vol. 004, No. 102 (M–022), Jul. 22, 1980 & JP 55 061311 A (Kawasaki Steel Corp), May 9, 1980.

Database WPI, Section Ch, Derwent Publications Ltd., London GB; & JP 46 037 086 B (Nippon Steel Corp).

*Primary Examiner*—Joseph J. Hail, III
*Assistant Examiner*—Ed Tolan
*Attorney, Agent, or Firm*—Freidrich Kueffner

[57] ABSTRACT

A method of rolling plates from input stock in several successively arranged work steps, wherein, depending on the desired end product, different numbers of n passes are carried out in one or more roll stands, preferably in a hot-rolling reversing stand. From a pass n–k to a pass n–1, greater pass reductions (smaller strip thicknesses) are rolled at the strip beginning than at the strip end, wherein k is a counting number in the range of from 1 to n–1.

5 Claims, 2 Drawing Sheets

METHOD OF ROLLING PLATES

BACKGROUND OF THE INVENTION

1. Field of the Invention

The present invention relates to a method of rolling plates from input stock in several successively arranged work steps, wherein, depending on the desired end product, different numbers of n passes are carried out in one or more roll stands, preferably in a hot-rolling reversing stand.

2. Description of the Related Art

When rolling plates from an input stock in a plate rolling stand, preferably in a hot-rolling reversing stand, the development tendencies are to roll strips which are as long as possible for reasons of maximizing productivity and yield (minimizing crop losses at the sides and ends). As a result of the process operation carried out usually for this purpose, hot reversing rolling with relatively small end thicknesses leads to very large rolling force differences between the strip beginning and the strip end, particularly in the last passes, wherein the differences may be, for example, up to 25,000 kN. The reason for this is the lower temperature of the rolling stock at the strip end caused by cooling taking place during rolling which requires the rolling work or rolling force to increase.

In order to counteract the effects of the cooling taking place during rolling in passes carried out successively, Patent Application WO-A-89/11363 proposes to heat the rolling stock up again at least after the first deformation step, preferably by means of an induction heating unit, and only then to carry out the second deformation step. However, this method is very expensive because it is necessary to install an appropriate furnace for this purpose and additional electrical energy must be used. In addition, it is very difficult to use this method in the case of reversing rolling.

SUMMARY OF THE INVENTION

Therefore, it is the primary object of the present invention to provide a method of the above-described type in which the disadvantages mentioned above during rolling in several successive rolling passes are eliminated or at least significantly reduced without requiring additional investment and energy costs.

In accordance with the present invention, in a method of rolling plates from input material in several successively arranged work steps in which depending on the desired end product different numbers of n passes are carried out in one or more roll stands, preferably in a hot-rolling reversing stand, the above-mentioned object is met by rolling, from the pass n−k to the pass n−1, greater pass reductions (smaller strip thicknesses) at the strip beginning than at the strip end, wherein k is a counting number in the range of from 1 to n−1.

As a result of the measure according to the present invention, according to which the patterns of the sheet thicknesses are configured starting at a pass n−k in the subsequent passes in such a way that greater reductions are rolled at the strip beginning as compared to the strip end, the rolling forces at the strip beginning are raised while the rolling forces at the strip end of the subsequent pass are lowered. Consequently, during the passes which are carried out in accordance with the present invention, the rolling force differences in each pass are rendered uniform. Moreover, rolling force peaks are generally reduced because the "thinner" strip beginning of the preceding pass is now rolled at the strip end of a pass. The reduction of the rolling force differences as well as the reduction of the absolute rolling force peak values are advantageous because of

- a reduction of the requirements on the adjusting systems for influencing the strip tolerances with respect to strip thickness, strip profile and planeness of the strip;
- an improvement of these tolerance values themselves because previous adjusting limits are no longer reached; and
- an expansion of the production spectrum because rolling force peaks, which in the past had the result that a product could no longer be produced, are avoided.

In accordance with an advantageous further development of the invention, the reduction of the pass decreases from the strip beginning to the strip end corresponding to the increase of the rolled strip thickness from the strip beginning to the strip end take place steadily, i.e., linearly. In this manner, the control of the required strip thickness can be carried out in a particularly simple manner by means of the adjusting systems.

However, it is also possible in accordance with the present invention to carry out a different, non-linear reduction of the pass decreases or increases of the rolled strip thickness from the strip beginning to the strip end, for example, in the form of a different predetermined mathematical function, if this is an advantage for carrying out the method steps for obtaining the desired end product.

The thickness difference between the strip beginning and the strip end is adjusted in accordance with the present invention with every subsequent pass to a smaller amount, so that, in accordance with the decrease of the average strip thickness due to the rolling progress, the thickness difference relative to the strip thickness remains essentially constant and, in relation to the strip thickness, is in the range of about 1–5%.

As mentioned above, the measure according to the present invention of allowing the strip thickness to increase from the strip beginning to the strip end begins with a pass n−k, wherein k is a counting number from 1 to n−1. Consequently, this measure can be started with the first pass (k=n−1) or also later, i.e., with the second pass, the third pass or the fourth pass, etc. The measure ends with the last pass at which the thickness difference still remaining from the preceding pass is equalized and parallel strip, i.e., the final product is produced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
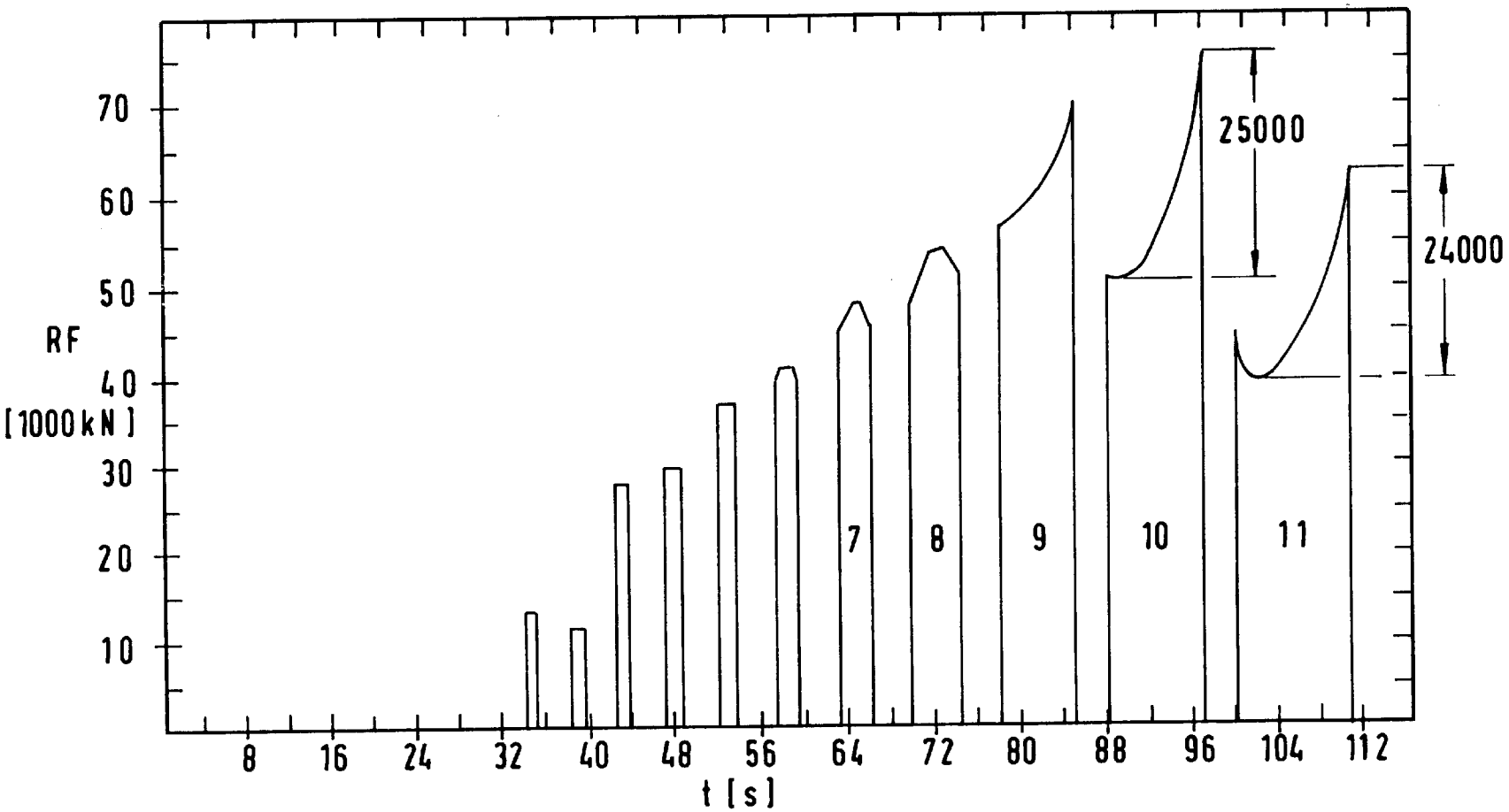
FIG.1 PRIOR ART
FIG. 1 is a schematic pass schedule of a rolling process with 11 passes in accordance with the prior art.

FIG. 1 of the drawing is a system of coordinates with the rolling forces RF in 1,000 kN as the ordinate and the rolling time t in seconds as the abscissa, in which the entire rolling process is illustrated with a total of 11 passes.

As can be seen in FIG. 1, a substantial increase of the rolling forces from the strip beginning to the strip end can be observed starting with the ninth pass 9, caused by the cooling of the rolling stock; in the tenth pass 10, the resulting rolling force difference is 25,000 kN and in the eleventh pass 11, the rolling force difference is 24,000 kN. The absolute rolling force peak is reached in the tenth pass 10 at the strip end with 76,000 kN.

Figure 2:
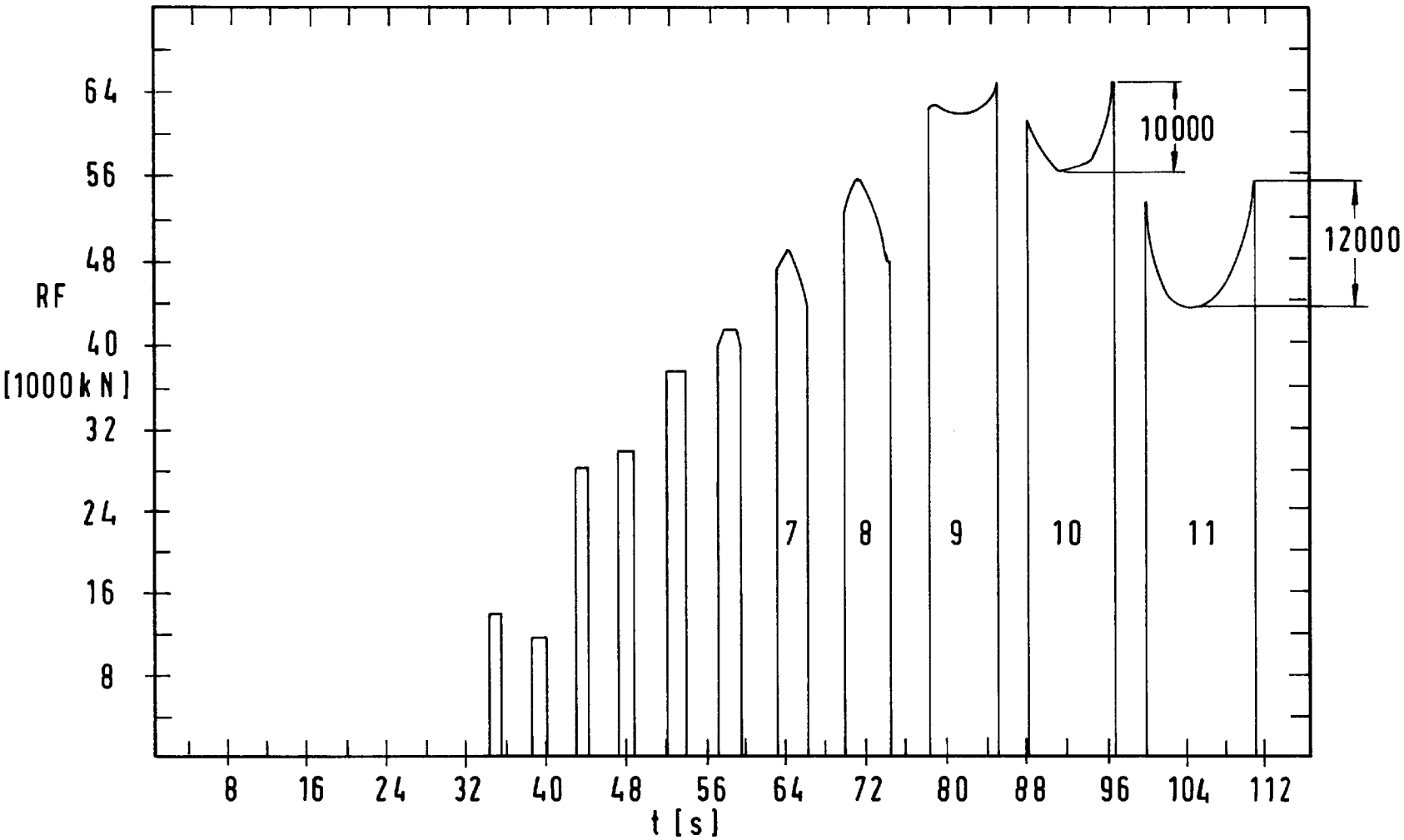
FIG. 2 is a schematic pass schedule of a rolling process with 11 passes in accordance with the method according to the present invention.

FIG. 2 of the drawing shows the result of a rolling process according to the method of the invention in which the conditions are otherwise the same as in the process of FIG. 1.

In the embodiment of FIG. 2, beginning with the seventh pass 7 corresponding to a k-number of 4, the pass reduction at the strip beginning was increased and correspondingly reduced toward the strip end, so that the strip thickness was increased toward the strip end. The resulting strip thickness difference toward the strip end was 0.6 mm. In the eighth pass 8 the strip thickness difference was 0.4 mm due to a greater pass reduction at the strip beginning, while the total strip thickness is now smaller; in the ninth pass 9 the strip thickness difference was 0.2 mm and in the tenth pass 10 the strip thickness difference was 0.1 mm. Consequently, in the last pass 11 in which a parallel strip is rolled as the finished product, it was also necessary to compensate a thickness difference of 0.1 mm from the tenth pass by an increased pass reduction at the strip beginning. The pattern of thickness increase from the strip beginning to strip end was linear in all passes.

As can also be seen in FIG. 2, the temperature-related rolling force difference between the strip beginning and the strip end was significantly reduced by raising the pass reduction at the strip beginning. Thus, this difference is only 10,000 kN in the tenth pass 10 and only 12,000 kN in the last pass 11; in other words, as compared to conventional methods, a reduction of the rolling force differences of about 50% is achieved.

The maximum rolling force values are also significantly lower in the last passes as compared to previously used methods, as can be seen from the following table:

| | | Maximum rolling force in kN | |
|---|---|---|---|
| Pass Number | k-Number | prev. meth. | meth. acc. to invention |
| 7 | 4 | 48,500 | 49,000 |
| 8 | 3 | 55,000 | 55,500 |
| 9 | 2 | 71,000 | 65,000 |
| 10 | 1 | 76,000 | 65,000 |
| 11 | 0 | 63,000 | 55,000 |

The measure according to the present invention which provides that the strip is rolled with different thicknesses in the last passes, i.e., with a smaller thickness at the strip beginning, which then increases again toward the strip end either linearly or non-linearly in accordance with a certain predetermined mathematical function, not only the rolling force differences between strip beginning and strip erd are reduced, but the maximum rolling force for each pass are also reduced. In addition to providing advantages in controlling by means of existing adjusting systems, the present invention especially also advantageously influences the service life of the parts of the rolling mill which are subject to wear and the energy requirement for rolling.

The present invention is not limited to the embodiment described in the drawing and the invention is not limited to rolling in reversing stands; rather, the invention can also be used generally and advantageously when rolling in several passes which are carried out successively, and when rolling in roughing trains and finishing trains.

While specific embodiments of the invention have been shown and described in detail to illustrate the inventive principles, it will be understood that the invention may be embodied otherwise without departing from such principles.

I claim:

1. A method of rolling plates from input material in several successive work steps, the method comprising carrying out a number of n passes in at least one reversing roll stand, wherein n depends on the desired end product, further comprising, starting with a pass n−k to a pass n−1, rolling greater pass reductions and smaller strip thicknesses at a strip beginning than at a strip end, wherein k is a counting number which is in the range of 1 to n−1, so that in each pass n−k to pass n−1, the strip beginning of a preceding pass having a smaller thickness is rolled at the strip end.

2. The method according to claim 1, wherein the at least one roll stand is a hot-rolling reversing stand.

3. The method according to claim 1, comprising carrying out the decrease of the pass reduction or the increase of the strip thickness from the strip beginning to the strip end linearly over the entire strip length.

4. The method according to claim 1, comprising carrying out the decrease of the pass reduction or the increase of the strip thickness from the strip beginning to the strip end non-linearly over the entire strip length in accordance with a different predetermined mathematical function.

5. The method according to claim 1, comprising decreasing the strip thickness difference between the strip beginning and the strip end with increasing pass number corresponding to a decreasing average strip thickness.

* * * * *